US005185603A

United States Patent [19]

Medin

[11] Patent Number: 5,185,603

[45] Date of Patent: Feb. 9, 1993

[54] APPARATUS FOR SYNCHRONIZING COMPUTER AND VIDEO IMAGES TO BE SIMULTANEOUSLY DISPLAYED ON A MONITOR AND METHOD FOR PERFORMING SAME

[76] Inventor: David L. Medin, 16 Putnam St., Greenwich, Conn. 06830

[21] Appl. No.: 552,024

[22] Filed: Jul. 13, 1990

[51] Int. Cl.[5] ..... G09G 3/00

[52] U.S. Cl. ..... 340/814; 358/148; 358/149

[58] Field of Search ..... 340/814; 358/140, 148, 358/149; 359/153, 154

[56] References Cited

U.S. PATENT DOCUMENTS 4,203,135 5/1980 Sasaki .
4,346,407 8/1982 Baer et al. ..... 358/148
4,450,480 5/1984 De La Cierva ..... 358/149
4,554,582 11/1985 Wine ..... 358/148
4,670,785 6/1987 Medin ..... 358/148

*Primary Examiner*—Ulysses Weldon
*Assistant Examiner*—Matthew Luu
*Attorney, Agent, or Firm*—Blum Kaplan

[57] ABSTRACT

An apparatus for synchronizing an external video sync signal and computer video sync signal includes a video sync generator for generating a horizontal video sync signal. A computer video controller generates a horizontal computer video sync signal. The computer video controller generates M horizontal computer video sync signals in the same time period that M−1 horizontal video sync signals occur.

22 Claims, 4 Drawing Sheets

APPARATUS FOR SYNCHRONIZING COMPUTER AND VIDEO IMAGES TO BE SIMULTANEOUSLY DISPLAYED ON A MONITOR AND METHOD FOR PERFORMING SAME

BACKGROUND OF THE INVENTION

This invention relates to an apparatus for synchronizing video signals and in particular, to an interface which enables computer generated images and video controlled images to be simultaneously displayed on a monitor.

Television video pictures including video cassette and camera transmitted pictures are produced utilizing interlaced signals comprised of an odd number of scan lines. For example, in the United States 525 scan lines are utilized and in Europe 625 scan lines are utilized. The television image is divided into two equal fields containing one-half of the total number of scan lines of a frame. Therefore, in the United States, each field has 262.5 scan lines while in Europe, each field has 312.5 scan lines.

Similarly, computers output computer signals to display an image on a monitor utilizing scan lines. Synchronizing pulses are utilized to maintain both the television video (herein after "video") image and computer generated video (hereinafter "computer video") image properly displayed on the monitor. The monitor relies on receipt of synchronizing pulses. The synchronizing timing of computer signals and the video signals are not the same.

Computer video signals are utilized to emulate video signals for video synchronization such as computer generated overlays or the like. Proper emulation requires the computer controller to exhibit similar vertical timing corresponding to the number of scan lines used in the video signals. Since each television scan line must correspond to each computer controller scan line, timing corrections made to the computer controller must be accomplished during the vertical timing period. However, computer video signals cannot be outputted as half scan lines to correspond to the television video field.

Several systems are known in the art for altering the computer video signal vertical timing to emulate that of a television video signal. One such system is known from U.S. Pat. No. 4,670,785 issued to the applicant in which the computer video controller is programmed to display one scan line less than the television signal and then stopping the clocking signal for the controller to effect a delay of one scan line. This system has been satisfactory. However, it suffers from the disadvantage that during this time period, when the clocking system is stopped, the video controller's ability to receive or transmit data is impaired or defeated. This has the result of slowing the speed at which the video controller can accept data which is directly related to the speed at which it can display data on the monitor. This results in an overall degradation of the video controller's performance.

Additionally, these prior art devices have utilized several phase lock loop or other locking methods to obtain horizontal synchronization. One such method is providing clock pulses to the computer video controller at a multiple of the horizontal synchronization frequency as is taught in U.S. Pat. No. 4,346,407 issued on Aug. 24, 1982. A second method is to provide clock pulses to a computer video controller at a known frequency so that the computer video controller will create a frequency that is intentionally higher than the external video frequency allowing the removal of pulses to achieve synchronization as is taught in U.S. Pat. No, 4,670,785 issued on June 2, 1987. A third method known in the art is to provide clock pulses to the computer video controller at a multiple of the chroma burst frequency. These methods have also been satisfactory. However, they suffer from the disadvantage that each of these methods utilize a closed loop system with the computer video controller out of the loop. They utilize either phase lock loops or gated oscillators designed to run at fixed frequencies. They do not allow for any variability in the compensation to the synchronization process.

Accordingly, it is desired to provide an apparatus for synchronizing computer video signals with television video signals which does not retard the video controller's ability to receive or transmit data.

SUMMARY OF THE INVENTION

Generally speaking, in accordance with the invention, an apparatus for synchronizing external video signals with computer generated video signals includes a video sync generator for receiving an external composite sync signal and producing in response thereto a sync output signal, horizontal video sync signal and a vertical video sync signal., A computer video controller outputs a computer video horizontal sync signal and a computer video vertical sync signal in response to a computer video clock which is determined as a function of the horizontal video sync signal, vertical video sync signal, horizontal computer video sync signal and vertical computer video sync signal. Timing of this signal output by the computer controller is initially determined by software or firmware and altered by the speed of the computer video clock which runs at a regular frequency until the leading edge of the vertical video sync signal. This triggers the computer video clock to run at a greater speed than the regular frequency so that the computer video controller outputs M horizontal video sync signals in the time M−1 horizontal video signals occur.

In an exemplary embodiment, a phase frequency comparator receives a horizontal computer video sync signal and a horizontal video sync signal and produces a voltage spike output response to the order in which the signals arrive. A voltage controlled oscillator receives the spike voltage and outputs a computer video clock. The computer video controller receives the computer video clock and outputs a horizontal computer video sync signal at a programmable multiple of the computer video clock in response thereto. By adjusting the parameters the computer video controller through inputs, the computer video clock may be controlled and accordingly, the manner in which the computer video signal and video signal are synchronized may be varied.

Accordingly, it is an object of the present invention to provide an improved apparatus and method for synchronizing a computer video signal to an external television video signal.

Another object of the invention is to provide a computer video int- face which does not degrade the image displayed on the monitor.

Yet another object of the invention is to provide an apparatus which synchronizes a video signal with a computer video signal without stopping the clocking signal for the controller.

A further object of the invention is to provide a method for synchronization in which a phase lock loop is designed with a computer video controller in the loop to allow variability in the frequencies at which the interface is to be operated.

Still other objects and advantages of the invention will in part be obvious and will in part be apparent from the specification.

The invention accordingly comprises the several steps and the relation of one or more of such steps with respect to each of the others, and the apparatus embodying features of construction, combinations of elements and arrangement of parts which adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
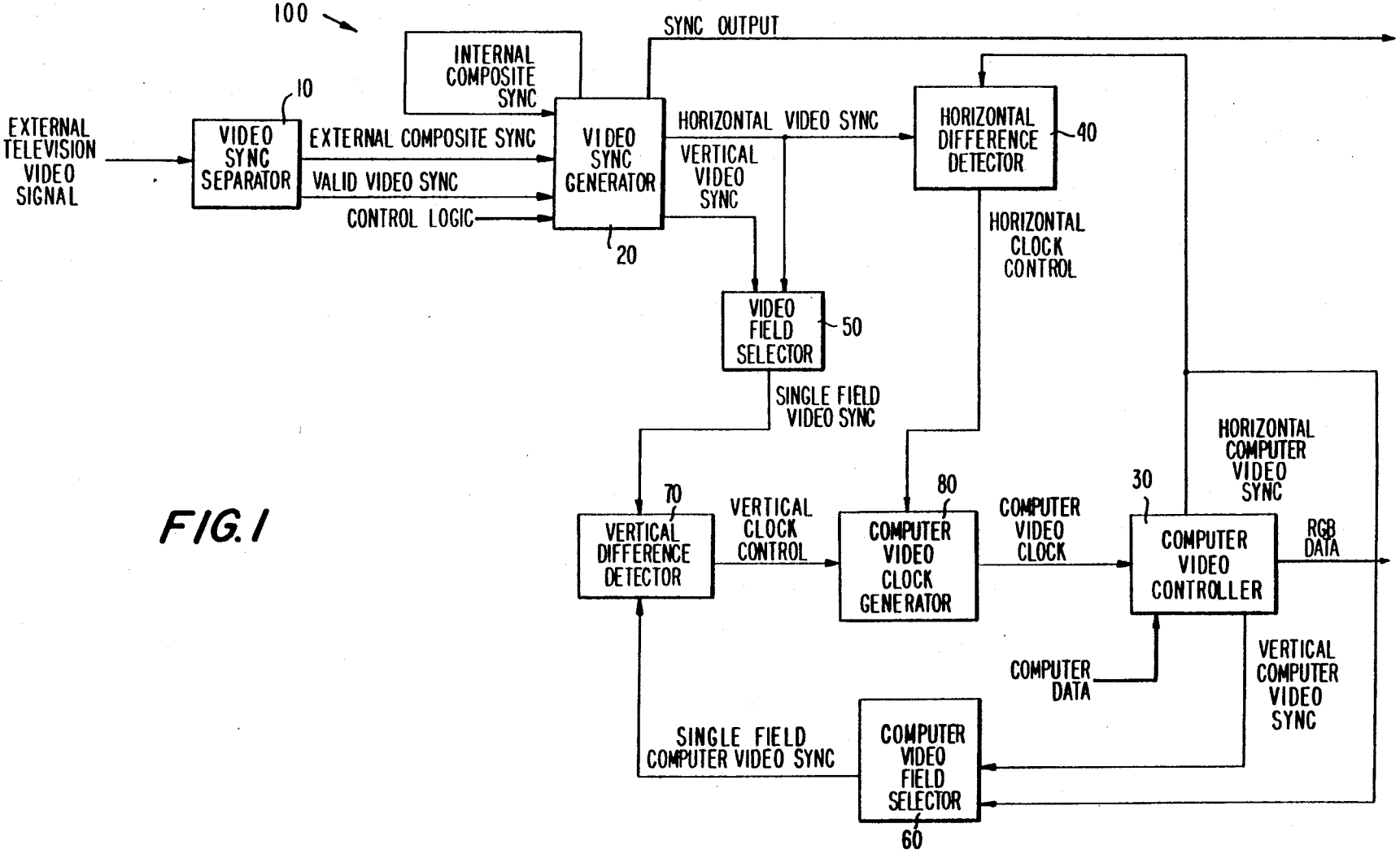
FIG. 1 is a block diagram of the apparatus for synchronizing computer and video images to be simultaneously displayed on a monitor constructed in accordance with the invention.
Figure 2:
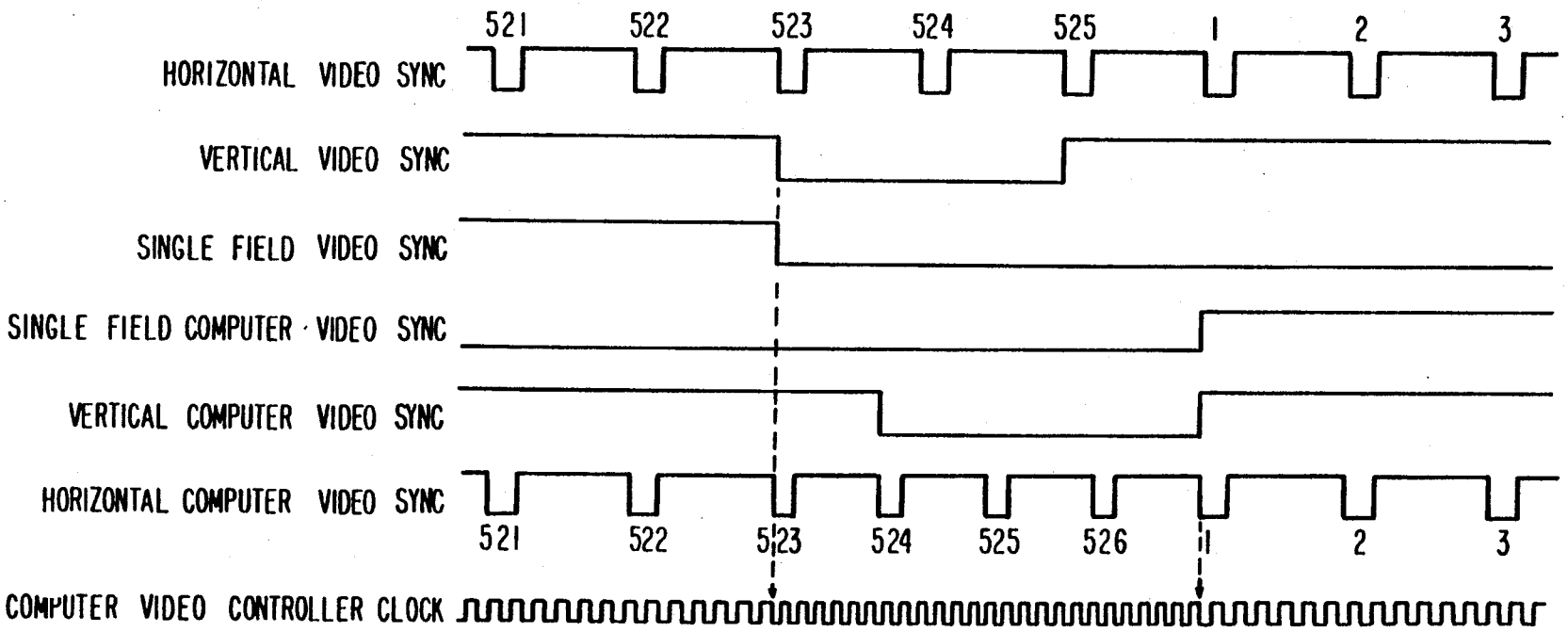
FIG. 2 is a timing diagram for the operation of the apparatus of FIG. 1.

Reference is had to FIGS. 1 and 2 in which an apparatus for synchronizing a video signal and a computer video signal, generally indicated as 100 and constructed in accordance with the invention is provided. Interface apparatus 100 includes a video sync separator 10 which receives an external video signal and breaks down the signal to output only the external composite sync signal including the horizontal sync signal of the external video signal and the vertical sync signal of the external video signal among other timing signals. Video sync separator 10 also outputs a valid video sync signal acting as a flag to indicate that an external video signal has been received by video sync separator 10.

A video sync generator 20 receives the external composite sync and the valid video sync signals as inputs. Video sync generator 20 also receives the control logic input from the host computer providing the graphics to determine in what manner the video sync generator should operate. The control logic signal causes the video sync generator 20 to search for the valid video sync input. If a valid video sync input is present, the video sync generator then determines that an external composite sync signal is being input.

Video sync generator 20 produces an internal composite sync signal which also consist of a horizontal video sync component and a vertical video sync component. The vertical video sync component may either be independently generated by the video sync generator or may be generated by locking onto the vertical video sync signal component of the external composite sync signal. By locking onto the vertical video sync signal of the external composite sync signal, the video sync generator 20 may compensate for transmission dropouts from the external composite sync signals as well as signal noise which may arise from its own internal signal.

The horizontal video sync signal of the external composite sync signal is utilized as the horizontal video sync signal of the internal composite sync signal. The horizontal video sync signal of the internal composite signal is independently generated by video sync generator 20 in the absence of an external composite sync signal.

When video sync generator 20 detects a valid video sync signal, it utilizes the horizontal sync signal of the external composite sync signal and the remaining components of the internal composite sync signal to output a sync signal. If no valid video sync signal is detected, then video sync generator 20 will output the internal composite sync signal as the sync output signal. Video sync generator 20 also outputs the horizontal video sync signal component of the sync output signal to a horizontal difference detector 40 and the vertical video sync signal component of sync output signal to a video field selector 50. The external composite sync signal includes other components such as the field indicator, blanking signals and the like which can be individually regenerated by video sync generator 20 through a signal locking mechanism and output as a component of the sync output signal.

Because the internal composite sync signal is self-contained, free running and has the same timing characteristics as the external composite sync signal, the internal composite sync signal has the capability to be synchronized to the external composite sync signal to increase immunity from noise. The sync output signal is output by video sync generator 20 and is output to the monitor to drive the monitor.

A computer video controller 30 receives computer data from the host computer corresponding to the data which is to be synchronized and displayed on the monitor and outputs an RGB data signal which drives the monitor in conjunction with the sync output signal of video sync generator 20. Computer video controller 30 also outputs a horizontal computer video sync signal and a vertical computer video sync signal. As will described in greater detailed below, the timing of each of these signals is determined by software and firmware which is altered by the timing of the computer video clock signal received by the computer video controller.

A horizontal difference detector 40 receives as a first input the horizontal computer video sync signal and as a second input the horizontal video sync signal output by video sync generator 20. These two signals are identical in frequency but vary as to timing of the individual pulses of the signal. Horizontal difference detector 40 detects the timing difference between the horizontal video sync signal and the horizontal computer sync signal and outputs a horizontal clock control signal in response thereto.

A video field selector 50 receives as inputs the horizontal video sync signal and the vertical video sync signal output by video sync generator 20. Video field selector 50 gates the horizontal video sync signal in response to the vertical video sync signal and outputs a single field video sync signal which indicates the beginning and ending of the video fields. Similarly, a computer video field selector 60 receives a vertical computer video sync signal and horizontal computer video sync signal output by computer video controller 30 and gates the computer video horizontal sync signal in response to the vertical computer video sync signal to output a single field computer video sync signal.

A vertical difference detector 70 receives the single field video sync signal and the single field computer video sync signal. Vertical difference detector 70 outputs a vertical clock control signal in response to the leading edge of the single field video sync signal and the trailing edge of the single field computer video sync signal.

Reference is now also made to FIG. 2 in which the timing of computer video clock generator 80 acting on every other field of a frame is provided. Computer video clock generator 80 continuously outputs a computer video clock having a frequency of a predetermined value. Computer video clock generator 80 receives the horizontal clock control signal output by horizontal difference detector 40 to regulate the frequency of the computer video clock. The horizontal clock control signal regulates the speed of the computer video clock generator to facilitate horizontal synchronization. The vertical clock control signal which is dependent on the vertical video sync signal and vertical computer video sync signal gates the operation of the horizontal clock control signal on the computer video clock generator 80 and determines when computer video clock generator 80 should output a computer video clock having a predetermined frequency or some divided value based upon the horizontal clock control signal. This achieves vertical synchronization of the outputs of computer video controller 30 and the outputs of video sync generator 20.

Specifically, computer video clock has a frequency X determined in accordance with horizontal synchronization. At the leading edge of the single field video sync signal, the vertical clock control signal triggers computer video clock generator 80 to produce a higher frequency computer video clock Xn ($Xn=X(M/M-1)$) in response to the horizontal clock control signal. This causes computer video controller 80 to produce M horizontal computer video sync signals in the same amount of time that the horizontal video sync signal exhibits $M-1$ horizontal sync signals. The trailing edge of the single field computer sync signal causes vertical difference detector 70 to output vertical clock control signal restoring computer video clock generator 80 to its previous state outputting a computer video clock having a frequency X.

As can be seen from FIG. 2 the trailing edge of every other vertical computer video sync signal is the completion of an entire frame represented by the single field video sync signal and corresponds to the leading edge of the horizontal video sync signal and horizontal computer video sync signal which begins a new frame of scanning. This higher frequency clock causes the computer to treat every other field as having an extra line (263 or 313) and the video to behave as if one field is larger by one line than the other (263, 262 or 313, 312). The faster clock is continued until the trailing edge of the single field computer video sync signal corresponding to the trailing edge of every other vertical computer video sync. The higher frequency clock may be started anywhere after the start of the vertical video sync signal. Because of this arrangement, the sped up clock frequency occurs within the vertical blanking period. No video data is present within the vertical blanking period. Since the video sync signals are used for display, the higher frequency computer video sync signals will present no problems.

In an exemplary embodiment, the computer video clock signal runs at a regular predetermined frequency X until the leading edge of the single field video sync signal. This triggers the computer video clock to run at a new frequency $X_n=4/3$ X. Accordingly, if the video computer sync signals and the video sync signals are previously synchronized, the video computer controller will produce four horizontal sync signal during the same period three video sync signals occur. At the trailing edge of the single field computer video sync signal, the computer video clock is reset to the frequency X. The 4/3 ratio is used by way of example only. Virtually any other ratio may also be used by adjusting the computer video clock speeds and the vertical computer video sync signal width and position.

If the computer video sync signals and the video sync signals are not previously synchronized, the ratio between the high frequency computer video clock and the standard frequency computer clock will determine the time involved in achieving synchronization. In the exemplary embodiment, the 4/3 ratio will always achieve synchronization in less than 0.1 seconds utilizing 525 scan lines and less than 0.12 seconds in systems utilizing 625 scan lines.

To increase the frequency of the computer video clock, a simple frequency divider may be utilized along with a switching mechanism so that when the predetermined frequency X is to be used it is directly input to the computer video controller. When the increased frequency is to be used then the increased frequency $X_n$ may be produced as a direct function of the frequency X. In a second method, the frequency X and $X_n$ need not be directly related. X is output utilizing a first phase lock loop which is locked to an internal value X or a multiple thereof and the frequency $X_n$ is output utilizing a phase lock loop which is phase locked to an internal value $X_n$ or a multiple thereof. In a third embodiment, the frequency X is produced utilizing a phase lock loop while the frequency $X_n$ may be left free running.

In a fourth embodiment, the PLL can be run at a frequency of $X \cdot X_n$. A divide by $X_n$ provides the clock having the frequency X and a divide by X, provides a clock having the frequency $X_n$. In this manner a dynamic divider which may switch between the two divide frequencies is provided.

Figure 3:
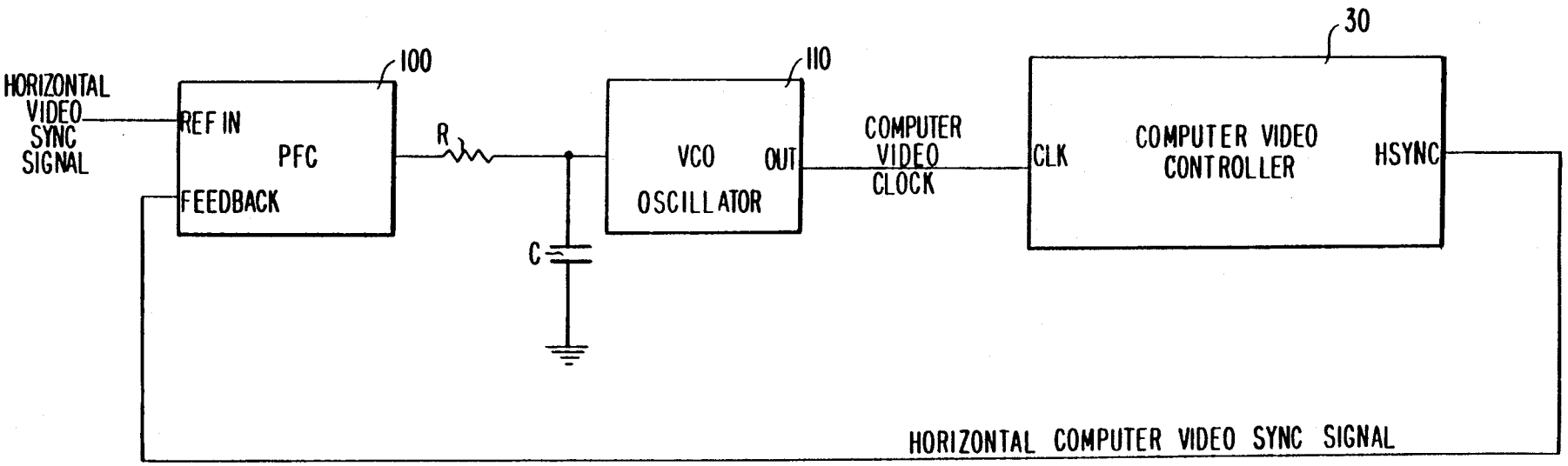
FIG. 3 is a block diagram of the horizontal difference detector, graphics clock generator and computer video controller constructed in accordance with one embodiment of the invention.

Reference is now made to FIG. 3 in which an exemplary embodiment of a structure for altering the frequency of the computer video clock corresponding to horizontal difference detector 40 and computer video clock generator 80 is provided. A phase frequency comparator 100 receives the horizontal video sync signal at a REF IN input and the horizontal computer video sync signal at a FEEDBACK input compares the two inputs and will output a voltage spike in response to the order in which the two signals arrive. The spike will either be positive or negative dependent upon which signal arrives first. However, whether the result is positive if the horizontal video sync signal arrives first is a matter of design choice.

The output voltage spike is then passed through an RC filter represented by a resistor R coupled between the output of phase frequency comparator 100 and a capacitor C which is coupled between resistor R and ground. The RC filter integrates the voltage spike and sets the DC level of the voltage spike. A voltage controlled oscillator 110 receives the integrated DC voltage level of the voltage spike and outputs a timing signal which is the computer video clock. The computer video clock is received at a clock input of computer video controller 30. Computer video controller 30 outputs the horizontal computer video sync signal at its HSYNC output in response to the computer video clock received as a clock input.

Computer video controller 30 is within a feedback loop determining the frequency and period of the computer video clock. Additionally, the computer video controller 30 is programmable and therefore the horizontal computer video sync signal may be varied to allow varying of the synchronization of the computer video signal and the external video signal.

If each scanned line is considered to have a number of clock cycles per line known as the line total and the line total is the total of the display size or number of clock cycles for display data plus a blanking size for a number of clock cycles for the blanking area, computer video controller 30 may be programmed to act as follows. Computer video controllers have numerous display methods known as modes. Modes may vary in display size, number of colors, resolution and presentation characteristics. Although each mode has a predetermined display size, the structure of FIG. 3 can adjust the blanking size in order to change the line total. Because the phase lock loop acts on the synchronization pulses and not a multiple of them, the following equation will also hold true:

$$\text{line total} \times \text{clock period} = \text{line period}$$

In which the clock period is dependent on the base frequency used by the controller to create a pixel, sync pulse and other screen information and the line period is the time required to scan an entire line. The line period is a fixed period equivalent to the line scan period of the external video. However, the line total may be varied by programming computer video controller 30.

By decreasing the blanking size and maintaining the display size and maintaining constant line frequency value, the clock period will increase and the display area of the screen will appear larger. Consequently by increasing the blanking size while maintaining a given display size and a constant line frequency value, the clock period will decrease and the display area of the screen will appear smaller. In this way the screen can be dynamically adjusted b changing the programming characteristics of the computer video controller. Unlike previous systems utilizing fixed frequencies, each mode can be adjusted for separate frequencies. Additionally, special effects such as overscan, underscan, pan and zoom can be realized with software simply by changing the timing of the computer video controller.

By adjusting the line total, the clock period automatically becomes adjusted to maintain the fixed value of the line period. Accordingly, the period of the computer video clock output by voltage control oscillator 110 will change with a change of the parameters of the computer video controller 30. Accordingly, through this feedback system a variable system for synchronizing an external video signal to an internal video signal is provided.

Figure 4:
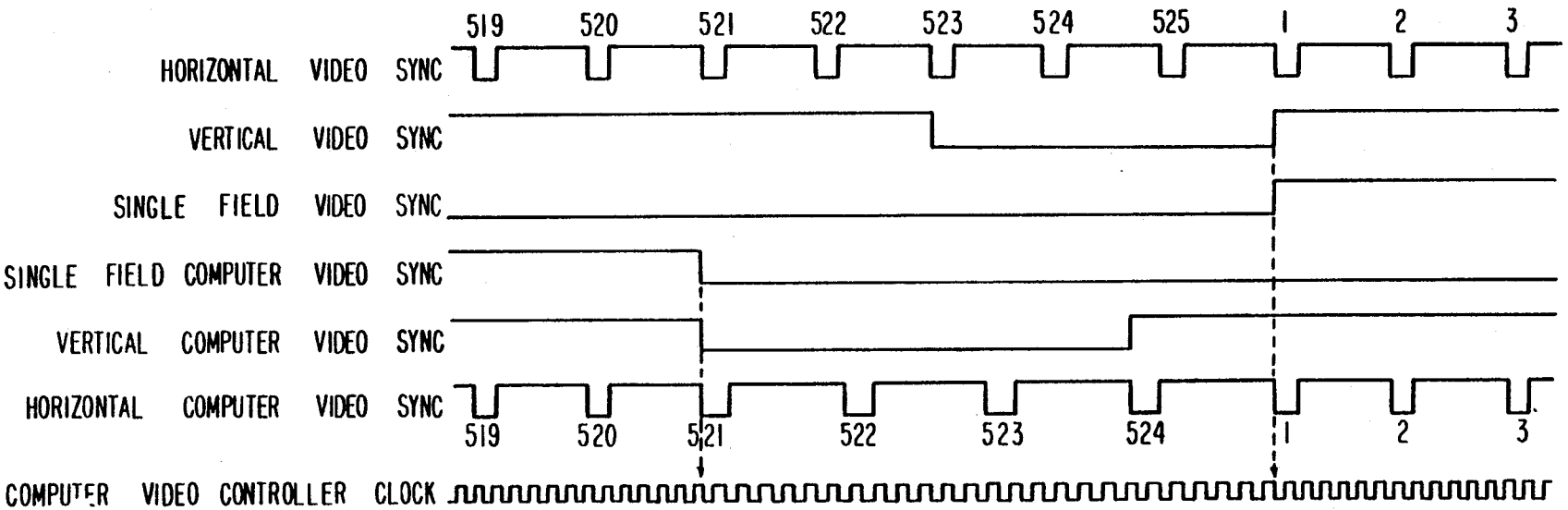
FIG. 4 is a timing diagram for the operation of the apparatus of FIG. 1 in accordance with another embodiment of the invention.

Reference is now made to FIG. 4 in which the timing of computer video clock generator 80 acting in accordance with another embodiment of the invention at every field of a frame in which the computer video controller clock is slowed down is provided. Computer video clock generator 80 continuously outputs a computer video clock having a frequency of a predetermined value. Computer video clock generator 80 receives the horizontal clock control signal output by horizontal difference detector 40 to regulate the frequency of the computer video clock. Again, the horizontal clock control signal regulates the speed of the computer video clock generator 80 to facilitate horizontal synchronization. The vertical clock control signal which in this embodiment is dependent on the vertical computer video sync signal gates the operation of the horizontal clock control signal on the computer video clock generator 80 and determines when computer video clock generator should output a computer video clock having a predetermined frequency or some multiple thereof to provide a lower frequency based upon the horizontal clock control signal. This achieves vertical synchronization of the outputs of computer video controller 30 and the outputs of video sync generator 20 by slowing down the computer video controller clock.

Specifically, it is again assumed that computer video clock has a frequency X determined in accordance with horizontal synchronization. At the leading edge of the single field computer video sync corresponding to the leading edge of the vertical computer video sync, the vertical clock control signal triggers computer video clock generator 80 to produce a lower frequency computer video clock $X_m$ in response to the horizontal clock control signal. This causes computer video controller 80 to produce M horizontal computer video sync signals in the same amount of time that the horizontal video sync signal exhibits at M+1 horizontal sync signals (524, 525 respectively, in this example). The trailing edge of the single field sync signal causes vertical difference detector 70 to output a vertical clock control signal restoring computer video clock generator 80 to its previous state outputting a computer video clock having a frequency X.

This lower frequency clock causes the computer to treat every other field as having one less line than the other (261, 262 or 311, 312). The slower clock is continued until the trailing edge of the single field video sync signal corresponding to the trailing edge of every other vertical video sync signal. The lower frequency clock may be started anywhere after the start of the vertical computer video sync signal. Because of this arrangement, the slowed down clock frequency occurs within the vertical blanking period. Again, no video data is present within the vertical blanking.

It will thus be seen that the objects as set forth above, among those made apparent from the preceding description, are efficiently attained and, since certain changes may be made in carrying the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention which, as a matter of language, migł be said to fall therebetween.

What is claimed is:

1. An apparatus for synchronizing video and computer images comprising:

video sync generator means for generator a horizontal video sync signal and vertical video sync signal; and computer video controller means including a computer video controller for outputting a horizontal computer video sync signal and a vertical computer video sync signal, a horizontal difference detector for receiving the horizontal computer video sync signal as one input and the horizontal video sync signal as a second input and outputting a horizontal clock control signal, a computer video clock generator for outputting a computer video clock having a first frequency, and increasing the frequency of the computer video clock in response to the horizontal clock control signal, and the computer video controller producing a horizontal computer video sync signal in response to the computer video clock for generating the horizontal computer video sync signals and increasing the number of generated horizontal computer video sync signals in response to said horizontal video sync signal and the vertical sync signal generating at least M horizontal computer video sync signals in the same time period that the video sync generator means generates M−1 horizontal video sync signals.

2. The apparatus for synchronizing of claim 1, wherein said video sync generator means receives an external composite sync signal and in response thereto produces the horizontal video sync signal and the vertical video sync signal.

3. The apparatus for synchronizing of claim 2, wherein said external composite sync signal includes a horizontal video sync signal component and a vertical video sync signal component, said video sync generator outputting the horizontal video sync signal component of the external composite sync signal when an external composite sync signal is present and generating an independent horizontal video sync signal when the external composite sync signal is not present, and producing a vertical video sync signal with the ability lock onto to the vertical video sync signal component of the external composite sync signal when present, an internal composite sync signal also comprising the internally generated horizontal video sync signal and the locked vertical video sync signal, the video sync generator outputting said internal composite sync signal as the sync output signal when no external composite sync signal is present and outputting the horizontal video sync signal component of the external composite sync signal and the locked vertical video sync signal as the sync output signal when an external composite signal is present.

4. The apparatus for synchronizing of claim 3, wherein said video sync generator receives a valid video sync signal in response thereto and determines whether to output the internal composite sync signal as the sync output or the horizontal video sync signal component of the external composite sync and the locked vertical video sync signal as the sync output.

5. The apparatus for synchronizing of claim 1, wherein said computer video controller means further comprises a video field selector which receives said vertical video sync signal and said horizontal video sync signal and produces a single field video sync signal in response thereto, a computer video field selector for receiving a vertical computer video sync signal and a horizontal computer video sync signal and outputting a single field computer video sync signal in response thereto, a vertical difference detector for receiving said single field video sync signal and said single field computer video sync signal and outputting a vertical clock control signal in response thereto, said computer video clock generator receiving said vertical clock control signal outputting said first clock frequency or said second clock frequency in response to said vertical clock control signal.

6. The apparatus for synchronizing of claim 1, wherein said computer video clock generator generates the second computer video clock frequency from a leading edge of the vertical video sync signal to a trailing edge of the next occurring vertical computer video sync signal.

7. The apparatus for synchronizing of claim 4, wherein said computer video controller means comprises a computer video controller for outputting a horizontal computer video sync signal and a vertical computer video sync signal, a horizontal difference detector for receiving the horizontal computer video sync signal as one input and the horizontal video sync signal as a second input and outputting a horizontal clock control signal, a computer video clock generator for outputting a computer video clock having a first frequency, and changing the frequency of the computer video clock to a second frequency in response to the horizontal clock control signal, the computer video controller producing a horizontal computer video sync signal in response to the computer video clock.

8. The apparatus for synchronizing of claim 7, wherein said computer video controller means further comprises a video field selector which receives said vertical video sync signal and said horizontal video sync signal and produces a single field video sync signal in response thereto, a computer video field selector for receiving a vertical computer video sync signal and a horizontal computer video sync signal and outputting a single field computer video sync signal in response thereto, a vertical difference detector for receiving said single field video sync signal and said single field computer video sync signal and outputting a vertical clock control signal in response thereto, said computer video clock generator receiving said vertical clock control signal and outputting one of said first clock frequency or said second clock frequency in response to said vertical clock control signal.

9. The apparatus for synchronizing of claim 8, wherein said computer video clock generator generates the second computer video clock frequency from a leading edge of the single field video sync signal to a trailing edge of the single field computer video sync signal.

10. The apparatus for synchronizing of claim 1, further comprising a phase frequency comparator means for comparing the horizontal video sync signal and the horizontal computer sync signal and producing a voltage signal output in response thereto and video controlled oscillator means for receiving said voltage signal and outputting a computer video clock, said computer video controller outputting said horizontal computer video sync signal in response to said computer video clock and said computer video controller being programmable, said computer video controller being programmed to vary the number of clock cycles per line scan.

11. The apparatus for synchronizing of claim 10, further comprising an RC filter coupled between said phase frequency comparator means and said voltage controlled oscillator means for integrating said voltage spike signal prior to being input to said voltage controlled oscillator means.

12. The apparatus for synchronizing of claim 1, wherein said computer video clock generator and said horizontal difference detector comprise a phase frequency comparator means for comparing the horizontal video sync signal and the horizontal computer sync signal and producing a voltage signal output in response thereto and the video controlled oscillator means for receiving said voltage signal and outputting a computer video clock, said computer video controller outputting said horizontal computer video sync signal in response to said computer video clock and said computer video controller being programmable, said computer video controller being programmed to vary the number of clock cycles per a line scan.

13. The apparatus for synchronizing of claim 1, wherein said horizontal computer video sync signal and said vertical computer video sync signal corresponding to a plurality of pixels on a display line, said computer video controller being programmable to change the number of pixels on a display line.

14. A method for synchronizing an external video sync signal and computer video sync signal comprising the step of generating a horizontal video sync signal;

generating a vertical sync signal;

outputting a horizontal computer video sync signal and a vertical computer video sync signal;

outputting a horizontal clock control signal in response to the horizontal computer video sync signal and horizontal video signal;

outputting a computer video clock having a first frequency and increasing the frequency of the computer video clock in response to the horizontal control clock signal;

outputting the horizontal computer video sync signal in response to the computer video clock; and generating M horizontal computer video sync signals in response to the horizontal video sync signals and the vertical sync signal in the same time period that M-1 horizontal video sync signals are generated.

15. The method of claim 14, further comprising the step of receiving an external composite sync signal and producing the horizontal video sync signal and the vertical video sync signal in response thereto.

16. The method of claim 15, further comprising the steps of determining whether an external composite sync signal is present and outputting the horizontal video sync signal component of the external composite sync signal as the horizontal video sync signal when an external composite sync signal is present and generating an independent horizontal video sync as the horizontal video signal when the external composite sync signal is not present, and producing the vertical video sync signal by outputting a signal locked on to the vertical video sync signal component of the external composite sync signal when an external composite sync signal is present and generating an independent vertical video sync signal when the external composite sync signal is not present, and producing an internal composite sync signal comprising the independent horizontal video sync signal and the independent vertical video sync signal, and outputting the internal composite sync signal as a sync output signal when no external composite sync signal is present and outputting the horizontal video sync signal component of the external composite sync signal and a locked vertical video sync signal as the sync output signal when an external composite signal is present.

17. The method of claim 14, further comprising the steps of producing a single field video sync signal in response to the vertical video sync signal and the horizontal video sync signal, producing a single field computer video sync signal in response to the vertical computer video sync signal and the horizontal computer video sync signal, outputting a vertical clock control signal in response to the single field video sync signal and the single field computer video sync signal and outputting said first clock frequency or said second clock frequency in response to the vertical clock control signal.

18. The method of claim 14, further comprising the step of generating a field indicator and blanking signals, said field indicator and blanking signals being components of said sync output signal.

19. The method of claim 14, wherein the time period is the time required to generate two fields of video information.

20. An apparatus for synchronizing video and computer images comprising:

video sync generator means for generating a horizontal video sync signal and vertical video sync signal; and computer video controller means including a computer video controller for outputting a horizontal computer video sync signal and a vertical computer video sync signal, a horizontal difference detector for receiving the horizontal computer video sync signal as one input and the horizontal video sync signal as a second input and outputting a horizontal clock control signal, a computer video clock generator for outputting a computer video clock having a first frequency, and increasing the frequency of the computer video clock in response to the horizontal clock control signal, and the computer video controller producing a horizontal computer video sync signal in response top the computer video clock for generating M horizontal computer video sync signals in response to said horizontal video sync signal and vertical video sync signal in the same time period that the video sync generator means generates N video sync signals wherein M and N are integers not equal to each other, M being greater than N, and the time period is the time required to generate two fields of video information.

21. An apparatus for synchronizing video and computer images comprising:

video sync generator means for generating a horizontal video sync signal and a vertical video sync signal; and computer video controller means for generating M horizontal computer video sync signals in response to said horizontal video sync video and the vertical sync signal in the same time period that the video sync generator means generates M−1 horizontal video sync signals, said computer video controller means including a computer video controller for outputting a horizontal computer video sync signal and a vertical computer video sync signal, a horizontal difference detector for receiving the horizontal com uter video sync signal as one input and the horizontal video sync signal as a second input and outputting a horizontal clock control signal, a computer video clock generator for outputting a computer video clock having a first frequency, and increasing the frequency of the computer video clock in response to the horizontal clock control signal, and the computer video controller producing a horizontal computer video sync signal in response to the computer video clock.

22. An apparatus for synchronizing video and computer images comprising:

video sync generator means for generating a horizontal video sync signal and vertical video sync signal;

computer video controller means for generating horizontal computer video sync signals in response to said horizontal video sync signal and the vertical sync signal, said computer video controller means including a computer video controller for outputting a horizontal computer video sync signal and a vertical computer video sync signal, a horizontal difference detector for receiving the horizontal video sync signal as one input and the horizontal video sync signal as a second input and outputting a horizontal clock control signal, a computer clock generator for outputting a computer video clock having a first frequency, and increasing the frequency of the computer video clock in response to the horizontal clock control signal, and the computer video controller producing a horizontal computer video sync signal in response to the computer video clock; and said computer video clock generator and said horizontal difference detector including a phase frequency comparator means for comparing the horizontal video sync signal and the horizontal computer sync signal and producing a voltage signal output in response thereto and a video controlled oscillator means for receiving said voltage signal and outputting a computer video clock, said computer video controller outputting said horizontal computer video sync signal in response to said computer video clock and said computer video controller being programmable, said computer video controller being programmed to vary the number of clock cycles per a line scan.

* * * * *